US010214939B2

(12) United States Patent
Garza Montemayor et al.

(10) Patent No.: US 10,214,939 B2
(45) Date of Patent: Feb. 26, 2019

(54) FENCE STRUCTURE

(71) Applicants: Jose Guadalupe Garza Montemayor, Nuevo Leon (MX); Jorge Eugenio Garza Montemayor, Nuevo Leon (MX)

(72) Inventors: Jose Guadalupe Garza Montemayor, Nuevo Leon (MX); Jorge Eugenio Garza Montemayor, Nuevo Leon (MX)

( * ) Notice: Subject to any disclaimer, the term of this patent is extended or adjusted under 35 U.S.C. 154(b) by 705 days.

(21) Appl. No.: 14/490,055

(22) Filed: Sep. 18, 2014

(65) Prior Publication Data

US 2015/0076434 A1 Mar. 19, 2015

(30) Foreign Application Priority Data

Sep. 18, 2013 (MX) ..... 2013/010663

(51) Int. Cl.
*E04H 17/14* (2006.01)

(52) U.S. Cl.
CPC ..... *E04H 17/1439* (2013.01)

(58) Field of Classification Search
CPC ..... E04F 11/181; E04F 11/1812; E04H 17/1439; E04H 17/08; E04H 17/22
USPC ..... 256/19, 22, 65.02, 65.14, DIG. 5; 52/600, 741.13–741.15
See application file for complete search history.

(56) References Cited

U.S. PATENT DOCUMENTS 2,662,739 A * 12/1953 Fisher ..... E04H 17/1443 256/19
2,846,241 A * 8/1958 McDonnell ..... B21C 37/296 285/192
2,987,299 A * 6/1961 Kneen ..... E04H 17/06 256/24
3,988,009 A * 10/1976 Mann ..... E04H 17/1426 256/24
4,311,300 A * 1/1982 Buerger ..... E04H 17/22 256/1
4,364,546 A * 12/1982 Lyman ..... E04H 17/165 256/19
4,723,760 A * 2/1988 O'Sullivan ..... E04H 17/1443 256/22
4,898,365 A * 2/1990 Conner ..... E04F 11/1834 256/22
5,613,664 A * 3/1997 Svalbe ..... E04H 17/003 256/19
6,017,019 A * 1/2000 Erwin ..... E04F 11/1834 256/60
6,890,461 B2 * 5/2005 Minayoshi ..... E04H 12/12 156/187

(Continued)

FOREIGN PATENT DOCUMENTS

EP 1878859 A2 1/2008
JP 2001214640 A 8/2001

(Continued)

*Primary Examiner* — Amber R Anderson
*Assistant Examiner* — Nahid Amiri
(74) *Attorney, Agent, or Firm* — Porzio Bromberg & Newman P.C.

(57) ABSTRACT

A fence structure comprising a plurality of posts, a lower guide base having a plurality of openings located at predefined distances for receiving the lower portion of each post, wherein the lower portion of the posts and the lower guide base are embedded in concrete.

8 Claims, 9 Drawing Sheets

(56) References Cited

U.S. PATENT DOCUMENTS

| | | | | |
|---|---|---|---|---|
| 7,044,448 | B1 * | 5/2006 | Jones | E04F 11/181 256/19 |
| 7,475,868 | B1 * | 1/2009 | Gibbs | E01F 15/06 256/1 |
| 8,348,242 | B2 * | 1/2013 | Rock | E04F 11/1817 256/22 |
| 2007/0200105 | A1 * | 8/2007 | Williams | B21D 39/044 256/22 |
| 2009/0001335 | A1 * | 1/2009 | Wilson | E01F 13/12 256/13.1 |

FOREIGN PATENT DOCUMENTS

| | | | |
|---|---|---|---|
| JP | 2004162360 | A | 6/2004 |
| JP | 2007239308 | A | 9/2007 |

* cited by examiner

FIGURA 6A

FENCE STRUCTURE

BACKGROUND OF THE INVENTION

Field of the Invention

The present invention relates to fence structures for industrial, commercial or residential use, and more particularly, to a fence structure having a lower guide base for ease of placement and fixation of straight fence elements—posts.

Background of the Invention

There are various types of fence structures for industrial, commercial and residential use which are comprised by a plurality of elements intended to provide structural rigidity and stability to said structure.

A fence structure is disclosed in Japanese Patent No. JP2001214640, in which several crossbars are installed in a plurality of piles spaced at required intervals, which lower ends are driven into soil, and wherein each pile has several sockets including inserting sections into which the terminals of the corresponding crossbars are inserted in a manner that the terminals are slipped off freely in the horizontal direction.

Another fence structure is disclosed in Japanese Patent No. JP2004162360, in which a post member and a crossbar member are connected together by a joint instrument. The post member has a lateral hole at the side face. The crossbar member has an opening formed substantially in parallel to the longitudinal axis of the crossbar. The joint instrument is provided with a rod member fitted in the lateral hole and fitted to the post member. A shaft member is attached to the crossbar so as to penetrate the notch substantially perpendicular to the face of an opening, and an arm member arranged in said crossbar notch, the position of which can be changed around the shaft member.

Japanese Patent No. JP2007239308 discloses a lattice fence in which "U" shape members are attached to the posts to retain the various fence elements.

European Patent No. EP 1878859 discloses a connecting element for fence crossbars and fence posts comprising a transverse flange (QF) which is flat or curved about the transverse flange (Q) and a vertical flange (HF) which lies outside of the plane of the transverse flange and is curved about the vertical axis (H). A transition web connects one edge of the transverse flange to an edge of the vertical flange whereby this connected edge of the vertical flange is further away from the transverse axis than the free edge of the vertical flange.

While the fence structures and connecting elements disclosed in the above-mentioned patents may have a suitable structural rigidity, the large number of elements composing them make it difficult for said fence structures to be manufactured and assembled, and due to its large number of elements, said fence structures are likely to fail, and its elements may work loose over time as a result of physical stress or corrosion.

For the purposes of providing a fence structure that is easy to manufacture and assemble, that has a suitable structural rigidity, and that has the smallest number of elements as possible so as to increase its duration, the Applicant has developed a fence structure for industrial, commercial or residential use, which comprises a plurality of posts, a lower guide base having a plurality of openings located at predefined distances for receiving the lower portion of each post, wherein the lower portion of the posts and the lower guide base are embedded in concrete.

Since the lower guide base has a plurality of equally-spaced openings, placement of posts is simplified as these openings indicate the place where posts should be placed and secured, thus avoiding the need of taking additional measurements at the installation site. Additionally, since the lower section of the posts is housed in the lower guide base filled with concrete, an excellent structural rigidity is achieved as the post is firmly secured, leaving no room for movement.

Finally, due to the reduced number of elements composing the fence structure, there are fewer elements which may fail and cause a structural failure as a result of physical stress or corrosion, which provides the fence structure of the present invention with a longer life.

SUMMARY OF THE INVENTION

Accordingly, it is a main object of the present invention to provide a fence structure for industrial, commercial or residential use which comprises a plurality of posts, a lower guide base having a plurality of openings located at predefined distances for receiving the lower portion of each post, wherein the lower portion of the posts and the lower guide base are embedded in concrete.

Another main object of the present invention is to provide a fence structure of the nature described above, which is easy to install due to the reduced number of pieces composing it and the openings indicating the place where posts should be placed and secured, thus avoiding the need of taking additional measurements at the installation site.

In addition, another object of the present invention is to provide a fence structure of the nature described above, in which, since the lower section of the posts is housed in the lower guide base filled with concrete, an excellent structural rigidity is achieved as the post is firmly secured, leaving no room for movement.

Still another object of the present invention is to provide a fence structure of the nature described above, which has a longer life than the current fence structures due to the reduced number of elements that may fail as a result of physical stress or corrosion.

The foregoing and other objects and advantages of the fence structure of the present invention will become apparent to those having an average skill in the art from the reading of this detailed description of the invention, which will be described by reference to the accompanying drawings.

BRIEF DESCRIPTION OF THE DRAWINGS

FIG. 6A is an upper perspective view of the temporary aligning crossbar of the fence structure of the present invention.

DETAILED DESCRIPTION OF THE INVENTION

Figure 1:
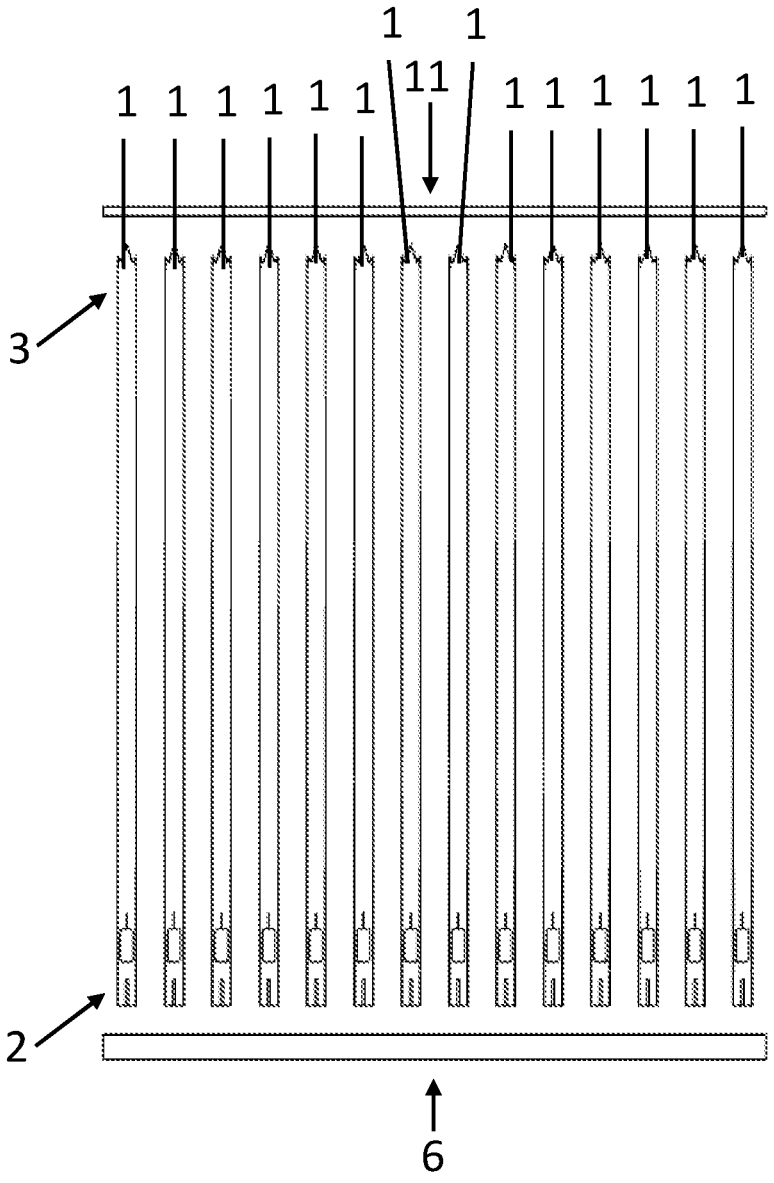
FIG. 1 is an exploded front view of the fence structure of the present invention.
Figure 2:
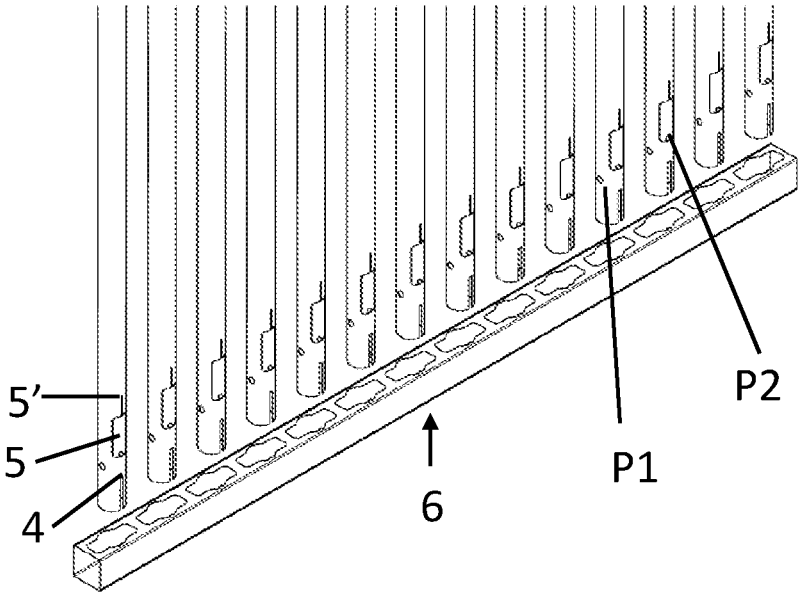
FIG. 2 is an exploded perspective view of the lower portion of the fence structure of the present invention.
Figure 3A:
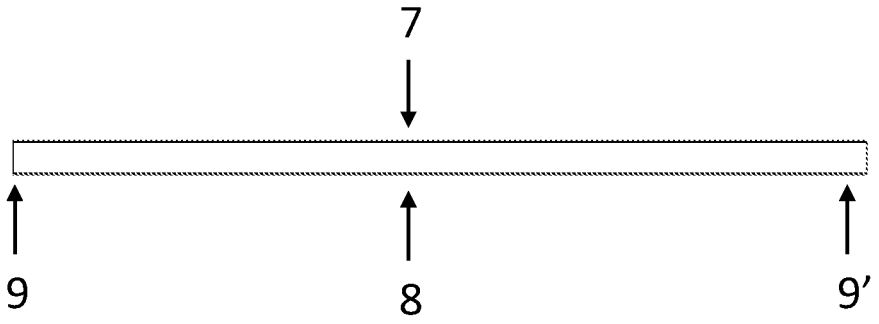
FIG. 3A is a front view of the lower guide base of the fence structure of the present invention.
Figure 3B:
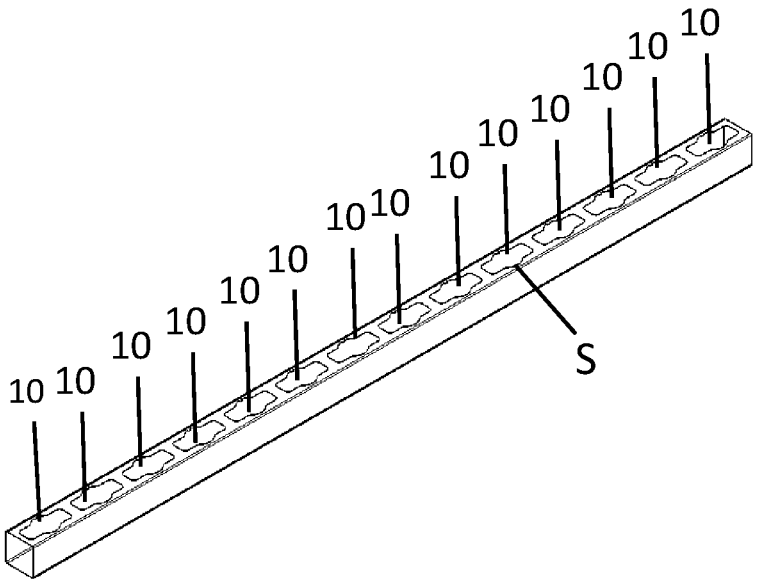
FIG. 3B is an upper perspective view of the lower guide base of the fence structure of the present invention.
Figure 4:
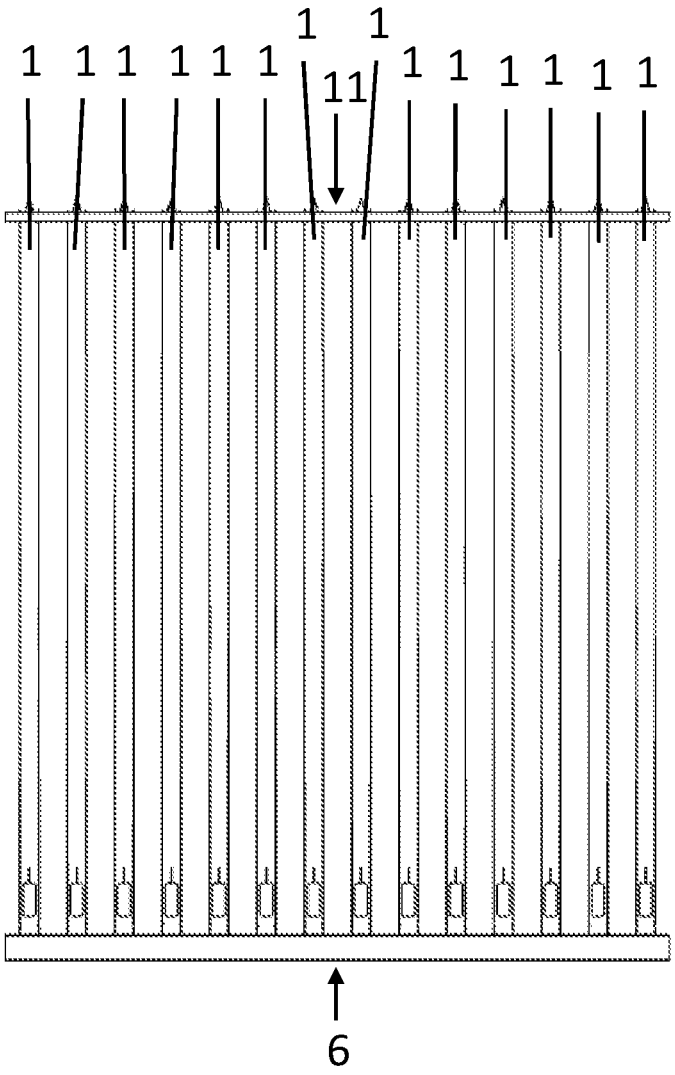
FIG. 4 is a front view of the fence structure of the present invention
Figure 5:
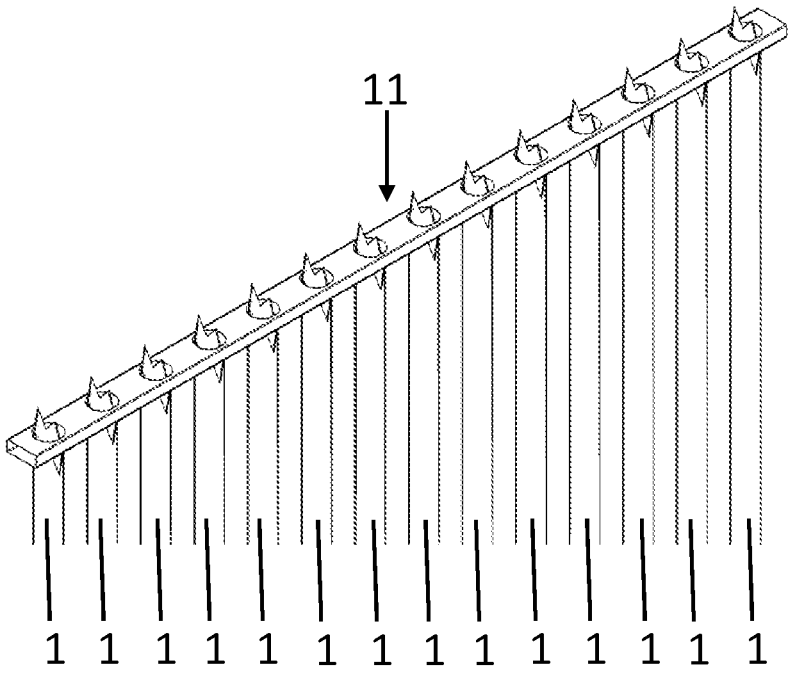
FIG. 5 is a perspective view of the upper portion of the fence structure of the present invention with its components assembled.
Figure 6B:
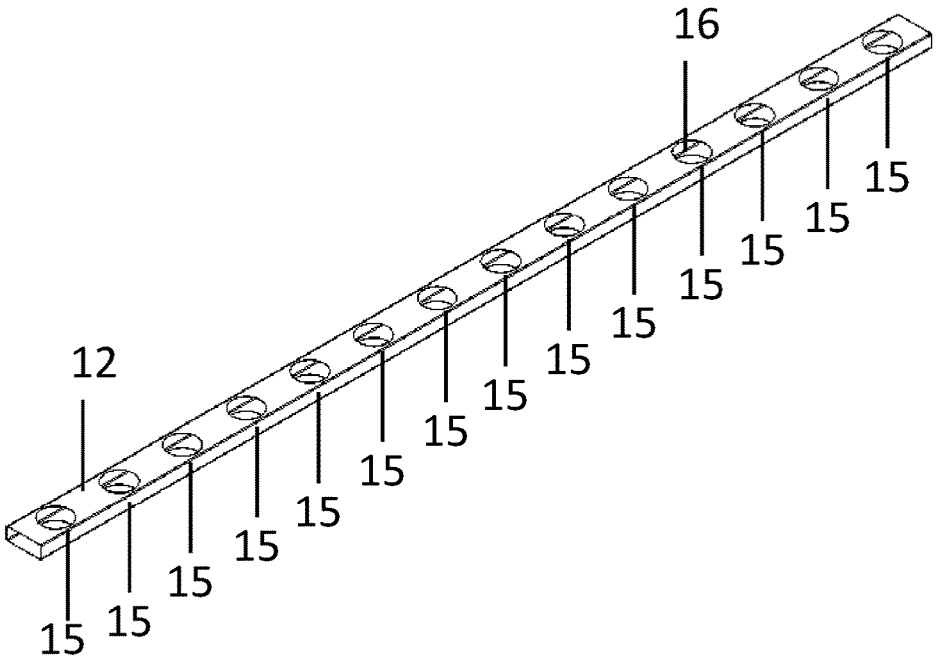
FIG. 6B is a left side view of the temporary aligning crossbar of the fence structure of the present invention.
Figure 6B:
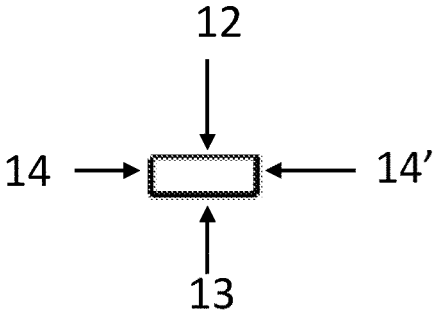
Figure 7:
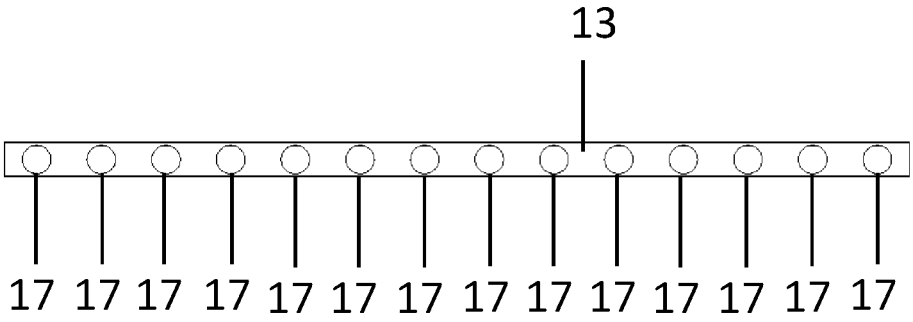
FIG. 7 is a lower view of the temporary aligning crossbar of the fence structure of the present invention.
Figure 8:
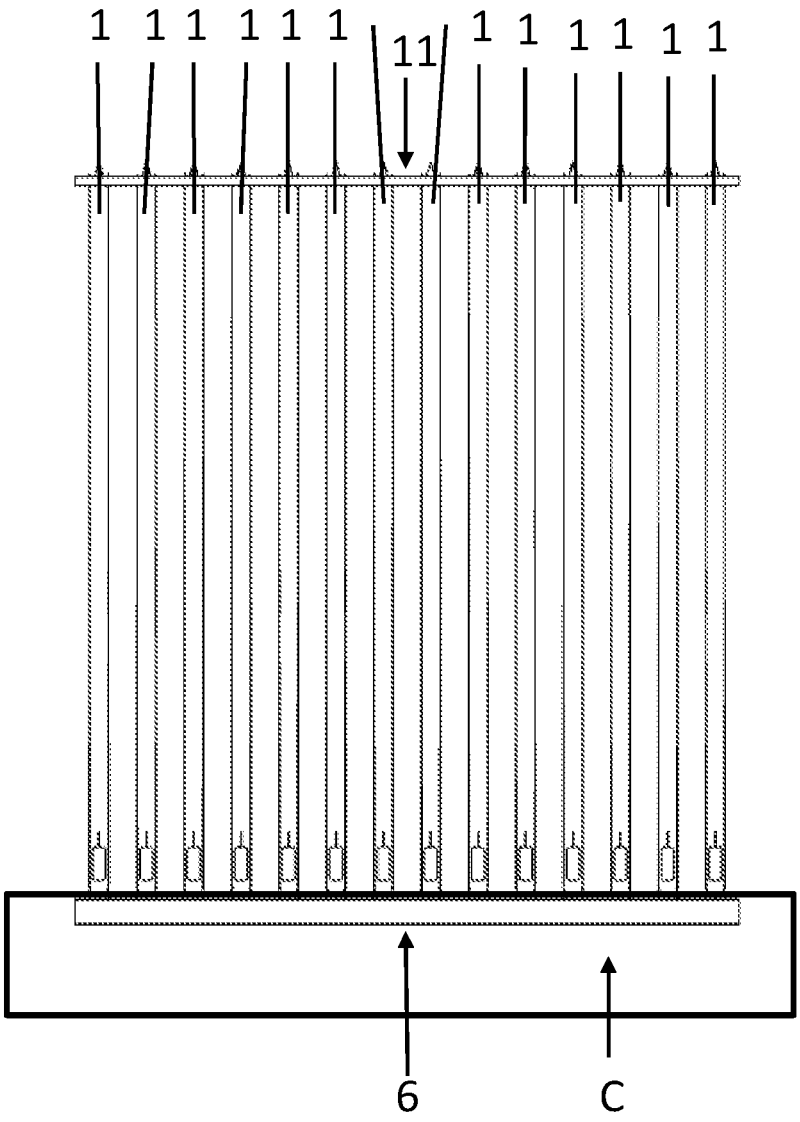
FIG. 8 is a front view of the fence structure of the present invention showing the lower guide base embedded in concrete.
Figure 9:
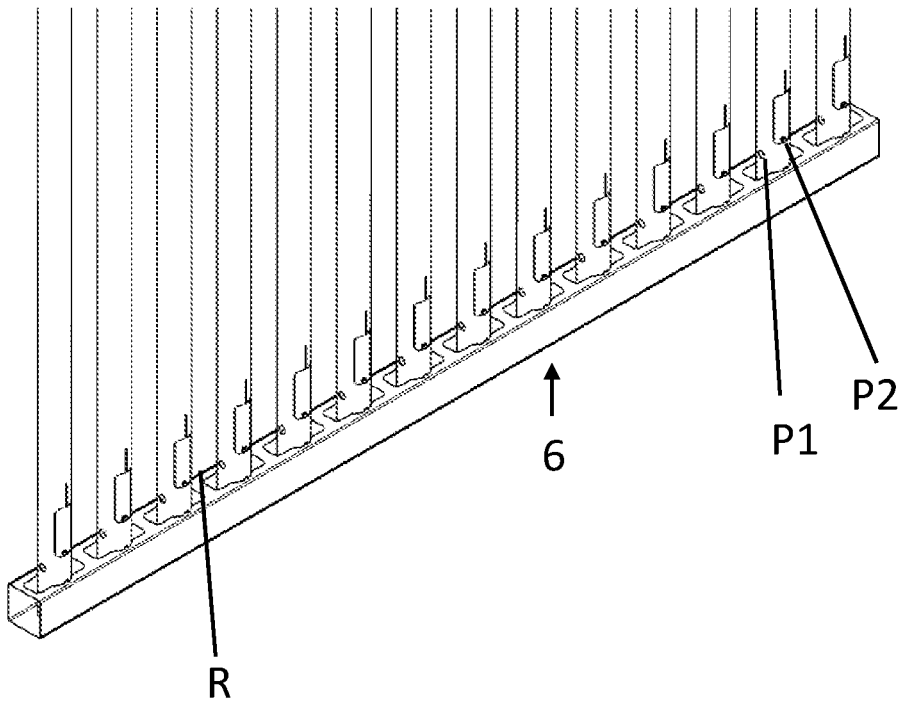
FIG. 9 is a perspective view of the lower portion of the fence structure of the present invention showing the support rod.

The fence structure of the present invention will now be described by reference to a preferred embodiment thereof and to the accompanying drawings, in which similar reference numbers refer to similar parts of the fence structure, wherein said fence structure comprises:

a plurality of posts (1), each one comprising a hollow metal cylinder having a lower open end (2), an upper open end (3), a rectangular pass-through notch (4) in the lower open end, an opening (5) for entrance of hardening material to the interior of the post located at an upper end of a respective rectangular notch, and a drain notch (5') located at an upper end of a respective opening; further including a first side perforation (P1) and a second side perforation (P2) linearly matching to each other, wherein the upper open end of each post may be covered with a lid (not shown), which in a preferred embodiment, has a circular shape, attached to the periphery of the upper open end (2) of the post (1);

a lower guide base (6) comprising an elongated hollow rectangular member with a quadrangular cross section having an upper surface (7), a lower surface (8) and two longitudinal ends (9, 9'), wherein the upper surface (7) has one or more rectangular-shape openings (10) located at predefined distances normally equidistant to each other, each opening including a guide projection (S), said lower guide base (6) being secured to a lower surface (not shown);

wherein, the lower open end (2) of each post (1) is inserted in a rectangular-shape opening (10) of the lower guide base (6), such that the pass-through notch (4) of each post fits into the respective opening (10) guided by the respective guide projection (S) which slips off through the notch, with the opening for entrance of hardening material (5), the drain notches (5') and the side perforations (P1) and (P2) of each post (1) lying outside of the lower guide base (6);

wherein a support rod (not shown) passes through each side perforation (P1) (P2) of each post (1), laterally crossing them to provide rigidity to the fence structure; and wherein the lower portion (2) of each post (1), the lower guide base (6) and the support rod are embedded in a hardening material mass comprising concrete C, which is filled to the interior of each post through the opening (5), with each post (1) being thus embedded in the lower guide base (6) and in the hardening materialmass C, with only the drain notches (5') of each post lying outside of the hardening material mass C, such that if water enters via the upper end of the tube, or if water is condensed inside the tube, it will be drained to the exterior by said drain notches (5').

As described above, the openings (5) located near the lower open end (2) of each post (1) allow for passage of fluid concrete to the interior of the post when it is poured in the lower guide base (6) at the time that the fence is manufactured.

Additionally, a temporary aligning crossbar (11) may be used in order to fix each post (1) in place during assembly of the fence and before the concrete poured in the lower anchor member (6) sets, said temporary aligning crossbar (11) comprising:

an elongated hollow metal member of rectangular cross section having an upper wall (12), a lower wall (13) and two side walls (14, 14'), wherein the upper wall has one or more circular-shape openings (15) located at predefined distances normally equidistant to each other, each one of which is covered by a semicircular wall (16) covering half of the circular-shape opening (15), which depends upon the upper surface (12), and wherein the lower wall (13) has a plurality of circular-shape openings (17) located at predefined distances normally equidistant to each other, each one of which matches a corresponding opening (15) of the upper wall (12);

wherein the cross section of each post passes tightly through a matching pair of respective circular-shape openings (15, 17), with the upper open end (3) of each post hitting with the semicircular wall (16) of the corresponding opening (15) of the upper wall (12) of the temporary aligning crossbar (11), such that the plurality of posts (1) is secured by said temporary aligning crossbar (11), thus preventing undesirable movements while the lower cement mass sets; and wherein each semicircular wall (16) covering each opening (15) of the upper wall (12) of the temporary aligning crossbar (11) serves as a stop with which the upper open end (3) of a corresponding post (1) hits, preventing the temporary aligning crossbar (11) from slipping off downwardly.

Each fence structure may preferably have a length between about 2 m and 3 m long, and more fence structures can therefore be added to cover a certain length.

While in the preferred embodiment described above the posts (1) are made from a metal material, it is to be understood that the same may be made from any material which meets the predetermined strength requirements, such as PVC, wood, etc.

Additionally, posts (1) may have a cross section of any shape, and the openings (10) of the lower guide base (6) and the temporary aligning crossbar (11) may therefore adopt any suitable shape, such that the cross section of each post (1) may enter through the same. The lids that may cover the upper ends (3) of each post (1) should have a shape that fits the cross section of the posts (1).

It is also to be understood that the lower guide base (6) may have a cross section of any shape, such as cylindrical, or any other shape that fits the lower surface on which the fence structure is seated.

Likewise, in other embodiments, instead of having one or more rectangular-shape openings (10), the lower guide base may have openings of a shape similar to that of the cross section of each post, and instead of openings, the lower guide base may even have circular notches or a shape corresponding to the shape of the cross section of each post, such that the walls (or circular wall) of the (hollow) post cross section pass through said notches.

As it will become apparent to one skilled in the art, when the notches on the upper surface (7) of the guide base are formed, a circular (or any other shape) element will be formed, which is surrounded by the notch, such that the circular element should be secured to the upper surface (7) by a portion of unnotched material, said portion of unnotched material being able to serve as a guide, such that when a post (1) is inserted through the notch, said portion of unnotched material slips off through the pass-through notch (4) of each post, serving as a guide.

Finally, it is to be understood that the fence structure of the present invention is not limited to the embodiment described above and that those experts in the art will be able, according to the teachings provided herein, to make any changes to the fence structure of the present invention, the scope of which will be defined exclusively by the following claims.

What is claimed is:

1. A fence structure comprising:

one or more hollow posts having: an upper open end and a lower open end, one or more pass-through notches located at the lower open end, and one or more openings for entrance of hardening material to the interior of the post, each of the one or more openings located at an upper end of said one or more pass-through notches; and a lower guide base comprising an elongated hollow member with an upper surface having one or more openings for receiving the lower end of each post, wherein the lower open end of each post are embedded in the lower guide base by means of a hardening material entering the lower guide base through the openings for entrance of hardening material of the post, wherein the lower open end of each post and the lower guide base are embedded in a hardening material mass driving each post into soil, and wherein the lower guide base comprises an elongated hollow rectangular member with a quadrangular cross section having an upper surface, a lower surface and two longitudinal ends, wherein the one or more openings are located at predefined distances normally equidistant to each other.

2. The fence structure according to claim 1, wherein each post further comprises:

one or more drain notches located at an upper end of said one or more openings, said drain notches allowing water to be drained to the exterior of the post if water enters the post or if water is condensed inside the post.

3. The fence structure according to claim 2 wherein the lower open end of each post is inserted in a rectangular-shape opening of the lower guide base, such that that said one or more openings for entrance of hardening material to the interior of the post and said one or more drain notches lie outside of the lower guide base, and wherein a lower portion of each post and the lower guide base are embedded in a hardening material mass comprising concrete, with each post being thus embedded in the lower guide base and in the concrete mass, with only the drain notches of each post lying outside of the concrete mass, such that if water enters inside of the post, or if water is condensed inside the tube, the water will be drained by said drain notches.

4. The fence structure according to claim 3, wherein said one or more openings for entrance of hardening material allow for passage of hardening material to the interior of the post when it is poured in the lower guide base at the time that the fence is manufactured.

5. The fence structure according to claim 1:

wherein the upper open end of each post is covered with a lid.

6. The fence structure according to claim 1, further comprising a first side perforation and a second side perforation in each post, linearly matching to each other; and a support rod passing through each side perforation of each post, laterally crossing them to provide rigidity to the fence structure, wherein the lower open end of each post are embedded in the lower guide base by means of a hardening material entering the lower guide base through the openings for entrance of hardening material of the post, and wherein the lower open end of each post and the lower guide base are embedded in a hardening material mass driving each post into soil.

7. The fence structure according to claim 1, wherein each opening of the lower guide base has a guide projection, which slips off through the pass-through notch of a respective post when inserted in the opening.

8. A fence structure comprising:

one or more hollow posts having: an upper open end and a lower open end, one or more pass-through notches located at the lower open end, and one or more openings for entrance of hardening material to the interior of the post, each of the one or more openings located at an upper end of said one or more pass-through notches; and a lower guide base comprising an elongated hollow member with an upper surface having one or more openings for receiving the lower end of each post, wherein the lower open end of each post are embedded in the lower guide base by means of a hardening material entering the lower guide base through the openings for entrance of hardening material of the post, wherein the lower open end of each post and the lower guide base are embedded in a hardening material mass driving each post into soil, and further comprising:

a temporary aligning crossbar to fix each post in place and prevent movement thereof during assembly of the fence and before the hardening material poured in a lower anchor member during the assembly of the fence sets, said temporary aligning crossbar comprising:

an elongated hollow metal member of rectangular cross section having an upper wall, a lower wall and two side walls, wherein the upper wall has one or more circular-shape openings located at predefined distances normally equidistant to each other, each one of which is covered by a semicircular wall covering half of the circular-shape opening, which depends upon the upper surface, and wherein the lower wall has a plurality of circular-shape openings located at predefined distances normally equidistant to each other, each one of which matches a corresponding opening of the upper wall;

wherein the cross section of each post passes tightly through a matching pair of respective circular-shape openings, with the upper open end of each post hitting with the semicircular wall of the corresponding opening of the upper wall of the temporary aligning crossbar, such that each post is secured by said temporary aligning crossbar, thus preventing undesirable movements while the hardening material sets; and wherein each semicircular wall covering each opening of the upper wall of the temporary aligning crossbar serves as a stop with which the upper open end of a corresponding post hits, preventing the temporary aligning crossbar from slipping off downwardly.

* * * * *